US006569311B2

(12) United States Patent
Bandlish et al.

(10) Patent No.: US 6,569,311 B2
(45) Date of Patent: May 27, 2003

(54) CONTINUOUS ELECTROCHEMICAL PROCESS FOR PREPARATION OF ZINC POWDER

(75) Inventors: Baldev K. Bandlish, Charlotte, NC (US); Vincent Wise Martin, Gastonia, NC (US)

(73) Assignee: Clariant Finance (BVI) Limited, Tortola (VG)

( * ) Notice: Subject to any disclaimer, the term of this patent is extended or adjusted under 35 U.S.C. 154(b) by 56 days.

(21) Appl. No.: 09/776,644

(22) Filed: Feb. 2, 2001

(65) Prior Publication Data

US 2002/0134689 A1 Sep. 26, 2002

(51) Int. Cl.[7] ..... C25C 1/16
(52) U.S. Cl. ..... 205/604; 205/603
(58) Field of Search ..... 205/74, 602, 603, 205/604

(56) References Cited

U.S. PATENT DOCUMENTS

| | | | | | |
|---|---|---|---|---|---|
| 3,326,783 | A | | 6/1967 | Winter | 204/10 |
| 3,860,509 | A | * | 1/1975 | Emmett, Jr. | 204/216 |
| 4,073,709 | A | * | 2/1978 | Pittie et al. | 205/594 |
| 4,115,210 | A | * | 9/1978 | Dekeister et al. | 205/74 |
| 4,139,429 | A | * | 2/1979 | Steward et al. | 204/237 |
| 4,234,401 | A | * | 11/1980 | Brannan | 205/101 |
| 4,272,333 | A | * | 6/1981 | Scott et al. | 204/222 |
| 4,431,496 | A | * | 2/1984 | Remick | 205/602 |
| 4,627,899 | A | * | 12/1986 | Smith et al. | 205/371 |
| 4,676,877 | A | | 6/1987 | Castillo et al. | 204/10 |
| 5,419,987 | A | | 5/1995 | Goldstein et al. | 429/229 |
| 5,635,051 | A | * | 6/1997 | Salas-Morales et al. | 205/560 |
| 5,720,867 | A | * | 2/1998 | Anastasijevic et al. | 204/237 |
| 5,958,210 | A | * | 9/1999 | Siu et al. | 205/602 |

FOREIGN PATENT DOCUMENTS

DE 23 28 254 1/1975

OTHER PUBLICATIONS

Jean St–Pierre and Dominique L. Piron, Electrowinning of zinc from alkaline solutions, Chapman and Hall Ltd., 1986, pp 447–556.*
English abstract for DE 2328254, Jan. 2, 1975.

* cited by examiner

*Primary Examiner*—Nam Nguyen
*Assistant Examiner*—Thomas H. Parsons
(74) *Attorney, Agent, or Firm*—Krishna Banerjee; Richard P. Silverman

(57) ABSTRACT

The present invention relates to a continuous electrochemical process for preparing zinc powder. The process involves providing to an electrochemical cell a suspension in a 1.25 Molar to 10.0 Molar aqueous alkaline solution of zinc oxide or any other zinc compound that reacts with an aqueous alkaline solution to produce zinc oxide, such that the solution or suspension comprises at least 2 millimoles of solubilized zinc based species per 100 grams of electrolyte. Current is passed to the cell at a current density of about 500 to 40,000 A/m$^2$, for a time period sufficient to electrochemically reduce the solubilized zinc based species to zinc powder, while continuously or intermittently adding a sufficient amount of the zinc oxide or the other zinc compound to the cell to maintain the concentration of the solubilized zinc based species at a level of at least 2 millimoles per 100 grams of electrolyte.

32 Claims, No Drawings

CONTINUOUS ELECTROCHEMICAL PROCESS FOR PREPARATION OF ZINC POWDER

BACKGROUND OF THE INVENTION

1. Field of the Invention

The present invention provides a continuous electrochemical process for the preparation of zinc powder from zinc oxide.

2. Description of the Related Art

Zinc powder is widely used in the chemical industry in various industries. Zinc oxide containing other zinc salts, metal impurities, etc. is produced as a byproduct. Recycling of the zinc oxide to produce pure zinc powder is highly desirable from a cost as well as an environmental point of view.

The electrodeposition of zinc metal is a well-known reaction in electrochemical technology (See, for example, D. Pletcher and F. C. Walsh, *Industrial Electrochemistry,* Blackie Academic, 1993). The electrogalvanizing of steel is a process carried out on a very large scale and aqueous acid is the normal medium. High speed, reel to reel galvanizing of steel is carried out in sulfuric acid with dimensionally stable anodes and uniform deposition is achieved at high current density by inducing very efficient mass transport by rapid movement of the steel surface. The deposition of zinc metal is also the critical electrode reaction in the electrowinning and electrorefining of zinc. In addition, there are a number of technologies, which have been demonstrated for the removal of Zn(II) from effluents. However, in these technologies, concentration of Zn(II) is low, commonly less than 100 ppm. Finally, the deposition of zinc has been widely investigated as the cathodic reaction in candidate secondary batteries. In all these applications, however, the objective is to select the conditions so as to give an adhesive and smooth zinc coating.

Zinc powder can be produced by electrolysis either in strong alkaline or neutral zinc containing solutions. The first patents obtained on the alkaline electrolysis process date back to the early thirties (German Patents, 581013, 506590, 653557). In these methods, concentration of zinc was low (approximately 30 grams per liter) and a low current density of 1200–1500 amperes/sq. meter was used. Volume efficiency and current density of these batch type processes are too low to be industrially attractive. I. Orszagh and B. Vass (Hung. J. Ind. Chem., 13,(1985) 287) used these methods to recycle zinc oxide byproduct from zinc dithionite production. They, however, used a divided cell at a low current density (1000–3000 A/m$^2$). Use of a divided cell and low current density makes this process significantly more capital intensive. In their study, no significant difference was observed at different sodium hydroxide concentrations.

For the recycling of zinc oxide containing waste by an alkaline electrolysis process to be industrially attractive, the alkaline electrolysis process needs to be improved to lower capital as well as operational expenses. Capital expenses can be significantly reduced by increasing the current density and by providing a process that is capable of being carried out in an undivided cell. Furthermore, electrolysis conditions need to be improved to achieve high volume efficiency and minimum corrosion of the electrodes. The present invention unexpectedly fulfills these and other needs.

One advantage of the present invention is that by providing a continuous process for the electrochemical reduction of zinc oxide (or any other zinc compound that reacts with an aqueous base to produce zinc oxide) to zinc powder, it provides for a very high volume efficiency, as solid zinc oxide (or the other zinc compound) is added continuously during the electrochemical process to maintain the concentration of zinc based species (such as $Zn^{2+}$ ions). Furthermore, the use of high current density coupled with high volume efficiency makes the presently claimed process industrially attractive.

J. St-Pierre, D. L. Piron (Electrowinning of zinc from alkaline solutions at high current densities; *J. Appl. Electrochem* (1990), 20(1), 163-5), discloses experimental results conducted at a current density of about 2000 to 8000 A/m$^2$ to obtain cell voltage and current efficiency data necessary for specific energy computations.

U.S. Pat. No. 5,958,210 discloses a method for electrowinning metallic zinc from zinc ion in aqueous solution, said method comprising performing electrolysis on a mixture of solid conductive particles and aqueous alkali solution, said solution ranging in concentration from about 3N to about 20N alkali and containing dissolved zinc ion at an initial concentration ranging from about 50 to about 500 grams of zinc ion per liter of said solution, in an electrolytic cell containing first and second vertically arranged, parallel flat plates defined as a current feeder and a counter electrode, respectively, said counter electrode coated with a substance that is catalytic for oxygen evolution, said cell further containing an ion-permeable diaphragm parallel to each of said plates and interposed therebetween to define a gap between said current feeder and said diaphragm, by passing said mixture of particles and solution through said gap such that said particles contact said current feeder and passing a current across said gap, thereby depositing metallic zinc from said solution onto said particles. The electrowinning process is disclosed to yield high current efficiency and low energy consumption. The process, however, is not industrially attractive for a large scale production of zinc powder because this process uses a relatively more complex cell, and a lower current density.

SUMMARY OF THE INVENTION

The present invention provides a continuous electrochemical process for preparing zinc powder, which comprises the steps of:

a) providing to an electrochemical cell a solution or suspension in an aqueous 1.25 Molar to 10.0 Molar base solution of zinc oxide or any other zinc compound that reacts with an aqueous base to produce zinc oxide, the solution or suspension containing at least 2 millimoles of solubilized zinc based species per 100 grams of electrolyte; and b) passing current to the cell at a current density of about 500 to 40,000 A/m$^2$, for a time period sufficient to electrochemically reduce the zinc based species to zinc powder, while continuously or intermittently adding a sufficient amount of the zinc oxide or the other zinc compound to the cell to maintain the concentration of the zinc based species at a level of at least 2 millimoles per 100 grams of electrolyte and continuously or intermittently removing at least a portion of the zinc powder formed;

wherein in steps a) and b), the electrolyte consists of the aqueous base solution and the zinc oxide or the other zinc compound, and the solubilized zinc species are derived from the zinc oxide or the other zinc compound.

DESCRIPTION OF THE PREFERRED EMBODIMENTS

The first step a) of the presently claimed electrochemical process for preparing zinc powder involves: providing to an electrochemical cell a solution or suspension in an aqueous 1.25 Molar to 10.0 Molar base solution of zinc oxide or any other zinc compound that reacts with an aqueous base to produce zinc oxide, the solution or suspension containing at least 2 millimoles of solubilized zinc based species per 100 grams of electrolyte.

As used herein, the phrase "zinc powder" encompasses zinc metal particles of various particle sizes known to one of ordinary skill in the art and is not limited to fine particles.

The electrolytic cell employed in the present invention may be an undivided or divided cell, with the undivided cell being preferred. Use of an undivided cell requires lower capital. Furthermore, operational costs are also lower when an undivided cell is used. Therefore, it is important that the process be capable of being carried out in an undivided cell, if desired.

Since zinc powder formed at the cathode by the reduction reaction can react with the oxygen generated at the anode, cathodic and anodic chemistries are generally separated by some kind of a porous diaphragm which allows the current to pass, but suppresses mixing of anolyte and catholyte. Cells of this kind are called divided cells.

The design of the undivided cell is simpler and the cell voltage required to achieve the desired current density is lower because of the lower ohmic resistance. This means that the electrical cost is generally lower where an undivided cell is used. Furthermore, capital cost required with the undivided cell is significantly lower than the divided cell.

The anode may be made from any conventional suitable material such as platinum, or iridium, either of which may be coated over an inert support such as niobium or titanium. The anode may also be made of nickel, or from conventional materials having good alkali corrosion resistance, e.g., lead or stainless steel. The cathode may be made from any conventional suitable materials having good alkali corrosion resistance, such as magnesium nickel, lead and stainless steel. Preferably, the anode in the present invention is formed of stainless steel and the cathode is formed of stainless steel, magnesium, or magnesium alloy.

The solubilized zinc based species are obtained by dissolving zinc oxide, or the other zinc compound (such as zinc sulfate) in an aqueous 1.25 M to 10.0 M base solution, and in one embodiment 2.5 M to 5.0 M, and in one embodiment 5.0 to 10.0 M base solution. High concentration (preferably obtained from a saturated solution of, or a light slurry of zinc oxide) of the solubilized zinc based species in the electrolyte is maintained during the electrolysis by adding ZnO or the other zinc compound either continuously or intermittently during the electrolysis.

Examples of solubilized zinc based species include $ZnO_2^{2-}$, $HZnO_2^{1-}$, $Zn(OH)^+$, and $Zn^{2+}$. Zinc oxide is known to dissolve by reacting with water to form a variety of species (which includes ionic and neutral species) depending upon pH. Thus a solution of zinc oxide in alkaline solution may contain species such as $ZnO_2^{2-}$, $HZnO_2^{1-}$, $Zn(OH)_2$, $Zn(OH)^+$, and $Zn^{2+}$. Therefore, solubilized zinc based species may comprise one or more of these species in the solution.

The concentration of solubilized zinc based species provided to the electrochemical cell is at least 2 millimoles (mmoles) per 100 grams (g) of electrolyte. The electrolyte comprises the aqueous 1.25 Molar to 10.0 Molar base solution and the zinc oxide or the other zinc compound. Preferably, the concentration of the solubilized zinc based species is at least 20 mmoles per 100 grams of electrolyte, and in one embodiment at least 30 mmoles per 100 grams of the electrolyte, and in one embodiment ranges from 2 to 120 mmoles per 100 grams of the electrolyte. By way of example, 2 weight percent of zinc oxide in the electrolyte corresponds approximately to 30 mmoles of solubilized zinc based species per 100 grams of the electrolyte. Also by way of example, 2 millimoles of zinc based species per 100 grams of electrolyte could be provided by dissolving 0.16 grams ($0.002 \times 81.37 = 0.16$) of zinc oxide in 99.84 grams of the 1.25 M to 10.0 M aqueous base solution.

Concentration of the aqueous base solution (such as caustic solution) should be as high as possible because of the higher solubility of zinc oxide in more concentrated aqueous base solutions. In order to achieve high current density (which is a function of the concentration of the electroactive species such as zinc based species), high current efficiency, and high volume efficiency (i.e., high amount of zinc produced per volume unit of electrolyte) it is desirable to use the electrolytes containing high concentration of solubilized zinc based species. Because of the higher solubility of zinc oxide in stronger base solutions, higher concentration of solubilized zinc based species is achieved by using stronger base solutions. By maintaining a light suspension of zinc oxide during the electrolysis in the present invention, the concentrations of solubilized zinc based species during the electrochemical process can be kept as high as possible. However, the concentration of solubilized zinc based species can be increased by using a stronger initial base solution used for solubilizing zinc oxide. It is generally believed that a higher concentration of base solution is favorable for minimizing corrosion of the anode. However, it has been unexpectedly found that high concentration (such as concentration significantly higher than 10.0 M) of base (e.g., NaOH solution) solution causes an adverse effect on corrosion of the stainless steel anode and on the current efficiency of the process especially where electrolysis is carried out at high current densities (such as higher than 10,000 $A/m^2$). This adverse effect is minimized by lowering the aqueous base concentration. The most preferred concentration of the aqueous base in the present invention is 3.0 to 5.0 M.

The aqueous base solutions employed in the process of the invention are prepared by combining water with a source of alkali metal or alkaline earth metal ions, such as lithium sodium and potassium, and a source of hydroxyl ($OH^-$ ions). A single source may of course provide both types of ions. The various alkali or alkaline earth metal ions are preferably supplied from various compounds such as hydroxides and oxides. Preferred base solutions are sodium and potassium hydroxide solutions.

The solubility of zinc oxide in the aqueous base solution is limited, and depends on the temperature. The present invention envisions use of the zinc oxide at any range of concentrations in which it is soluble in the aqueous base solution. However, the concentration of the electroactive species—in this case solubilized zinc based species—is a major variable that determines the maximum feasible current density at which zinc is electrodeposited at maximum current efficiency. An excessive current density will generally lead to secondary reactions such as hydrogen evolution (with a potential for some safety problems). Thus, too low a concentration of zinc based species in the electrolyte at high current densities will lead to lower current efficiency and hence is undesirable from cost and safety considerations. Hence, in the present invention, a saturated solution or a light suspension of zinc oxide (or the other zinc compound that produces zinc oxide upon reaction with aqueous base) is maintained. In one embodiment, the zinc oxide or the other zinc compound which produces the zinc oxide is present in the aqueous base in an amount of 0.15 to 12 weight percent (wt.%) calculated at 90° C., and in one embodiment from 1.5 to 6 wt. % calculated at 90° C., based on the weight of the electrolyte. At 90° C., a saturated solution of zinc oxide in 4.0 M NaOH contains 2 wt % of zinc oxide, based on the total weight of the electrolyte.

The second step b) of the presently claimed invention involves passing current to the cell at a current density of 500 to 40,000 amps per square meter $A/m^2$, preferably 1,000 to 40,000 $A/m^2$, and in one embodiment from 1000 to 5,000, in one embodiment, 10,000 to 20,000, in one embodiment 20,000 to 30,000, and in one embodiment, 30,000 to 40,000 $A/m^2$, and in one embodiment 10,000 to 40,000 $A/m^2$, for a time period sufficient to electrochemically reduce the solubilized zinc based species to zinc powder. Since the present process is a continuous process, while current is passed to the cell, a sufficient amount of zinc oxide or the other zinc compound is added to the cell continuously or intermittently to maintain the concentration of the solubilized zinc based species at a level of at least 2 mmoles of solubilized zinc based species per 100 grams of the electrolyte. Also, while current is passed to the cell, at least a portion of the zinc powder formed is removed continuously or intermittently.

While the present invention is not limited in scope by current efficiency considerations, in one embodiment, the present electrochemical process has a current efficiency of at least 70% (i.e., current efficiency of 70–100%), and in one embodiment at least 80%, and in one embodiment at least 90%. As used herein, the phrase "current efficiency" is the ratio, generally expressed as a percentage, of the actual zinc deposition rate to the rate which would be achieved if all of the current passing through the cell were consumed by reduction of zinc ion. The current efficiencies in zinc electrowinning cells are typically less than 100% because of the concurrent reduction of water to hydrogen gas, competing with the reduction of the solubilized zinc based species (e.g., from zinc oxide) to zinc metal at the cathode.

For electrolysis, temperatures higher than ambient are generally desired because of the beneficial effects on the kinetics of all steps in an electrode process. At higher temperatures, the diffusion coefficient, the exchange current density and the rates of chemical reactions generally are increased. The decrease in viscosity and increase in diffusion coefficient leads to the increased mass transport rates. This increased mass transport of zinc species from the bulk of the solution to the cathodic region is highly desirable. However, increase in the rate of chemical reaction such as the oxidation of zinc produced with oxygen and mass transport of the byproduct oxygen to the bulk of the solution may not be desirable. In the present invention, higher than ambient temperatures are found to be favorable for the electrolytic reduction of zinc oxide to zinc, and are thus preferred.

Thus, in one embodiment, the presently claimed electrochemical reduction process is conducted at a temperature of from 30° C. to 120° C., preferably from 50° C. to 110° C., and more preferably from 70° C. to 100° C.

In one embodiment of the present invention, the electrochemical process is substantially free of electrode corrosion. As used herein, the phrase "substantially free of electrode corrosion" encompasses corrosion levels, expressed as milligrams of electrode metal lost to corrosion/mole of electrons passed of 100 or less (i.e. $\leqq$100 mg/mole of electrons). In one embodiment, the corrosion levels are less than or equal to 50 mg/mole of electrons, and in one embodiment less than or equal to 40, 30, 20, 10, and 5 mg/mole of electrons. Methods for measuring corrosion levels will be known to one of ordinary skill in the art. In one embodiment, as in the present invention, it is measured by analysis of the recovered zinc powder for iron ion concentration by atomic absorption spectroscopy or inductively coupled plasma, as iron lost by corrosion is insoluble in the aqueous base solutions of the present invention.

The following specific examples will provide detailed illustrations of the methods of producing and utilizing compositions of the present invention. These examples are not intended, however, to limit or restrict the scope of the invention in any way and should not be construed as providing conditions, parameters or values which must be utilized exclusively in order to practice the present invention. Unless otherwise specified, all parts and percents are by weight.

EXAMPLES

Example 1

General procedure 1, 2, or 3 is used for the continuous electrolytic reduction of zinc oxide to zinc powder.

General Procedure 1

In these experiments, a 4-liter (L) resin Kettle (4 inch in diameter and 18 inch high) is used as the cell. A saturated solution of zinc oxide in the aqueous sodium hydroxide solution (3 to 3.5 liters) at 50 to 80° C. is charged into the resin kettle. A thermometer, stainless steel cathodes and anodes are positioned in the cell using laboratory clamps. Mixing is achieved by pumping (a centrifugal pump-March #BC-3C-MD is used) the solution of ZnO from the bulk of the solution to the region between cathodic and anodic plates. Parts of the cathode and anode surfaces are covered with Teflon tape to achieve the desired active cathode and anode surface areas. Electrolysis is carried out at various current densities and the number of coulombs passed is measured by using a digital coulometer. Additional zinc oxide is added to the cell during the electrolysis. A portion of the zinc deposited on the cathode is removed periodically. At the end of the experiment, zinc particles are separated from the electrolyte by decantation, washed with water and then dried. Dried zinc particles were analyzed to determine the zinc content.

General Procedure 2

Same as general procedure 1, except that a gear pump (Micropump #GL-H23FFSE) is used to mix the ingredients in the cell.

General Procedure 3

Same as general procedure 1, except that mechanical stirring (rather than pumping of solution) is used to mix the ingredients in the electrochemical cell.

Example 2

The results of electrolysis of zinc oxide (continuous process) under various conditions using general procedure 1, 2, or 3 are shown below in Table 1.

TABLE 1[1]

| Exp. No. | [NaOH][2] (M) | Moles ZnO added during electrolysis[3] | Concentraion of solubilized zinc based species (mmoles/100 g electrolyte)[4] | Moles of electrons passed | Temp. (° C.) | Current Density (A/m$^2$) | Zn produced (moles) | Current Efficiency (%) | Anode Corrosion (mg lost/mole electrons) | General Procedure |
|---|---|---|---|---|---|---|---|---|---|---|
| 1 | 4.0 | 1.23 | 24 | 2.48 | 73–78 | 19375 | 1.18 | 95 | 37 | 1 |
| 2 | 1.3 | 1.46 | 2 | 3.12 | 60–74 | 21053 | 0.79 | 51 | 6.3 | 1 |
| 3 | 2.8 | 1.77 | 12 | 6.55 | 63–69 | 20192 | 1.57 | 48 | 8.5 | 1 |
| 4 | 4.0 | 2.11 | 24 | 6.07 | 57–66 | 20192 | 2.22 | 73 | 33 | 2 |
| 5 | 4.0 | 10.69 | 24 | 22.55 | 76–96 | 18849 | 10.74 | 95 | 2 | 3 |
| 6 | 4.0 | 1.28 | 24 | 3.03 | 66–93 | 29206 | 1.52 | 100 | 1 | 3 |
| 7 | 4.0 | 1.64 | 24 | 2.90 | 81–109 | 35185 | 1.40 | 96 | 2 | 3 |
| 8 | 4.0 | 1.59 | 24 | 3.21 | 55–78 | 1500 | 1.47 | 91 | 4 | 3 |
| 9 | 1.3 | 1.03 | 2 | 3.35 | 69–84 | 1500 | 0.93 | 56 | 2 | 3 |
| 10 | 10.0 | 1.54 | 100 | 2.69 | 74–89 | 20317 | 1.26 | 94 | 79 | 3 |

[1]In all these experiments, stain steel (316 stainless steel) anode and cathode are used. Inter electrode distance is 2 cm.
[2]Concentration of NaOH before ZnO is dissolved in it.
[3]Initial electrolyte is a saturated solution of ZnO in aqueous base solution
[4]These concentrations are approximate values only.

In the above experiments, in general, current efficiency is lower when mass transport is achieved by a gear pump (general procedure 2) rather than a centrifugal pump (general procedure 1) or by mechanical stirring (general procedure 3) (Compare Experiment No. 4 with Experiment Nos. 1 and 5). While not wishing to be bound by theory, it is believed that this is caused by the greater mixing of the zinc produced at the cathode with the oxygen produced at the anode in the case of mixing by the gear pump than in mixing by the centrifugal pump or mechanical stirring.

Example 3

The volume efficiency advantages of the presently claimed continuous process over a corresponding noncontinuous solution process is illustrated by comparing Experiment Number 5 in Table 1 above with a noncontinuous solution process. The noncontinuous solution process uses the general procedure 3 except for the following differences: Zinc oxide is not added continuously during the electrolysis. All of the zinc oxide (80.2 g; 0.99 mole) is present initially in the electrolyte. About 1.76 moles of electrons is passed during the electrolysis, and the current density is 20202. The number of moles of zinc powder produced is 0.75. The current efficiency is 85.5%. The electrode surface area for the anode or cathode is 19.8 cm$^2$. The temperature of electrolysis is 57–62° C. The level of corrosion is 3 mg/mole of electrons. The maximum volume efficiency (assuming that all of the zinc based species in the solution has been reduced to zinc powder) for the noncontinuous solution process is 2.13 g of zinc per 100 milliliter (ml) of the electrolyte, while the continuous process, corresponding to Experiment Number 5 in Table 1 above has an intermittent volume efficiency (defined as the volume efficiency obtained after the electrolysis is terminated subsequent to passing the desired charge through the cell) of 23.5 g of zinc per 100 ml of electrolyte after passing 22.5 moles of electrons (2,175,600 coulombs)). The theoretical volume efficiency of the continuous process may approach infinity since, zinc oxide is being supplied continuously in the continuous process.

Each of the documents referred to above is incorporated herein by reference in its entirety, for all purposes. Except in the Examples, or where otherwise explicitly indicated, all numerical quantities in this description specifying amounts and concentrations of materials, reaction and process conditions (such as temperature, current density, current efficiency), and the like are to be understood to be modified by the word "about".

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A continuous electrochemical process for preparing zinc powder which comprises the steps of:

a) providing to an electrochemical cell a suspension in a 1.25 Molar to 10.0 Molar aqueous alkaline solution of zinc oxide or any other zinc compound that reacts with an aqueous base to produce zinc oxide, the suspension comprising at least 2 millimoles of solubilized zinc based species per 100 grams of electrolyte; and b) passing current to the electrochemical cell at a current density of about 500 to 40,000 A/m$^2$, for a time period sufficient to electrochemically reduce the zinc based species to zinc powder, while continuously or intermittently adding a sufficient amount of the zinc oxide or the other zinc compound to the cell to maintain the concentration of the solubilized zinc based species at a level of at least 2 millimoles per 100 grams of electrolyte and continuously or intermittently removing at least a portion of the zinc powder formed;

wherein in steps a) and b), the electrolyte comprises the aqueous alkaline solution and the zinc oxide or the other zinc compound.

2. The process of claim 1, wherein the electrochemical cell comprises stainless steel electrodes.

3. The process of claim 1, wherein the electrochemical cell has a magnesium or magnesium alloy cathode.

4. The process of claim 1, wherein in step a), the aqueous base solution comprises ions of at least one alkali or alkaline earth metal and hydroxyl ($OH^-$) ions.

5. The process of claim 4, wherein the alkali or alkaline earth metal ions are selected from the group consisting of sodium, potassium, and mixtures thereof and are provided in the form of a compound selected from the group consisting of hydroxides, and oxides.

6. The process of claim 5, wherein the compound is selected from sodium hydroxide and potassium hydroxide.

7. The process of claim 6, wherein the compound is sodium hydroxide.

8. The process of claim 1, wherein in step a), the solubilized zinc based ions comprise at least one member selected from the group consisting of $ZnO_2^{2-}$, $HZnO_2^{1-}$, $Zn(OH)^+$, and $Zn^{2+}$.

9. The process of claim 1, wherein in step a), the solubilized zinc based species comprise $Zn^{2+}$.

10. The process of claim 1, wherein in step a), the solubilized zinc based species are $Zn^{2+}$.

11. The process of claim 1, wherein in step a), the zinc oxide is present in an amount of up to about 12 wt. % calculated at 90° C., based on the weight of the electrolyte.

12. The process of claim 1, wherein step b) is carried out at a temperature range of from about 30 to about 110° C.

13. The process of claim 1, wherein step b) is carried out at a temperature range of from about 50 to about 110° C.

14. The process of claim 1, wherein step (b) has a current efficiency of at least 70%.

15. The process of claim 1, wherein the electrochemical process is substantially free of electrode corrosion.

16. The process of claim 1, wherein the electrode corrosion is corrosion of the anode and is less than or equal to 100 milligrams of lost anode metal/mole of electrons.

17. The process of claim 16, wherein the corrosion of the anode is less than or equal to 50 milligrams of lost anode metal/mole of electrons.

18. The process of claim 16, wherein the corrosion of the anode is less than or equal to 5 milligrams of lost anode metal/mole of electrons.

19. The process of claim 16, wherein the anode metal is stainless steel.

20. The process of claim 16, where the anode metal is nickel.

21. The process of claim 1, wherein in step a), the concentration of the solubilized zinc based species is about 2 to 120 mmoles per 100 grams of the electrolyte.

22. The process of claim 1, wherein in step a), the concentration of the solubilized zinc based species is at least 20 mmoles per 100 grams of the electrolyte.

23. The process of claim 1, wherein in step a), the aqueous base solution has a concentration of about 1.5 to about 8.0 M.

24. The process of claim 1, wherein in step a), the aqueous base solution has a concentration of about 3.0 to about 5.0 M.

25. The process of claim 1, wherein in step b), the current density is in the range of about 1,000 to 40,000 $A/m^2$.

26. The process of claim 1, wherein in step b), the current density is in the range of about 5,000 to 40,000 $A/m^2$.

27. The process of claim 1, wherein the electrochemical cell is an undivided cell.

28. The process of claim 1, wherein the other zinc compound is zinc sulfate.

29. A continuous electrochemical process for preparing zinc powder which comprises the steps of:

a) providing to an electrochemical cell a suspension of zinc oxide in a 1.25 Molar to 10.0 Molar aqueous alkaline solution, the suspension of zinc oxide comprising at least 2 millimoles of solubilized zinc based species per 100 grams of electrolyte; and b) passing current to the electrochemical cell at a current density of about 500 to 40,000 $A/m^2$, for a time period sufficient to electrochemically reduce the zinc based species to zinc powder, while continuously or intermittently adding a sufficient amount of the zinc oxide to the electrochemical cell to maintain the concentration of the solubilized zinc based species at a level of at least 2 millimoles per 100 grams of electrolyte and continuously or intermittently removing at least a portion of the zinc powder formed;

wherein in steps a) and b), the electrolyte comprises the aqueous alkaline solution and the zinc oxide.

30. The process of claim 29, wherein in step a), the solubilized zinc based species comprise at least one member selected from the group consisting of $ZnO_2^{2-}$, $HZnO_2^{1-}$, $Zn(OH)^+$, $Zn(OH)_2$, and $Zn^{2+}$.

31. The process of claim 29, wherein in step a), the solubilized zinc based species comprise $Zn^{2+}$.

32. The process of claim 29, wherein the electrochemical cell is an undivided cell.

* * * * *